United States Patent [19]

Haigh et al.

[11] 3,999,653

[45] Dec. 28, 1976

[54] PACKAGING FOR HAZARDOUS LIQUIDS

[75] Inventors: Daniel H. Haigh, Sanford; Richard H. Hall; Edwin G. Larson, both of Midland, all of Mich.

[73] Assignee: The Dow Chemical Company, Midland, Mich.

[22] Filed: Mar. 11, 1975

[21] Appl. No.: 557,446

[52] U.S. Cl. ..... 206/584; 206/594; 229/14 C; 220/63 A; 206/524.5

[51] Int. Cl.[2] ..... B65D 81/02; B65D 5/62; B65D 25/14; B65D 25/34

[58] Field of Search ..... 206/521, 3, 5, 84; 220/63 A; 229/14 C

[56] References Cited

UNITED STATES PATENTS

| | | | |
|---|---|---|---|
| 1,408,757 | 3/1922 | Metzger | 206/521 |
| 3,352,472 | 11/1967 | Cummings et al. | 229/14 B |
| 3,664,904 | 5/1972 | Cook | 220/63 A |

*Primary Examiner*—Ro E. Hart
*Assistant Examiner*—Douglas B. Farrow
*Attorney, Agent, or Firm*—Robert B. Ingraham

[57] ABSTRACT

A package containing a hazardous liquid is provided. The package comprises a container which is generally impermeable to a hazardous liquid contained therein, the container being subject to discharge of its contents when subjected to impact. The container is disposed within a first jacket of a liquid permeable material of sufficient strength to contain fragments of the container on rupture thereof. A second jacket is provided over first jacket, the second jacket having at least an inner wall and outer wall, the inner wall being liquid permeable, a hazardous liquid swellable body being contained between the inner wall and outer wall and being generally co-extensive with the inner wall and the outer wall, and a third jacket of a hazardous liquid vapor impervious membrane. The package provides substantial improvement in safety when transporting a container containing a hazardous liquid.

11 Claims, 8 Drawing Figures

PACKAGING FOR HAZARDOUS LIQUIDS

Shipment of hazardous materials, particularly in small quantities has presented a significant problem for many years. By the term "hazardous liquid" as employed herein, is meant organic chemicals such as solvents and aqueous solutions or dispersions which are hazardous to human health, welfare, are a fire hazard and/or in ecological contaminant. Small quantities of such materials are frequently shipped in glass containers which are generally packaged with padding of various types to provide resistance to impact. Generally such padding over a container of hazardous material is enclosed within a relatively rigid enclosure such as a corrugated paper board box. Oftentimes when such packages are subjected to impact of sufficient magnitude to rupture the inner glass container, the contents of the container permeate the packing as well as the remains of the corrugated board box presenting a fire hazard or a hazard to human health and on occasion contaminate other materials because of the failure to retain the liquid released from the broken container. Many different packages have been employed for the transportation of containers having hazardous liquids therein. Generally such containers do not retain the liquid if the inner container is broken.

It would be desirable if there were available an improved package for the shipment of hazardous liquids.

It would also be desirable if there were available an improved package for the shipment of hazardous liquids in friable containers.

It would also be desirable if there were available an improved method for the packaging of hazardous liquids.

These benefits and other advantages in accordance with the present invention are obtained in a package for the containment and shipping of hazardous liquids within a container which is subject to discharge of the contents of the container when the container is subjected to impact sufficient to rupture the container, the package comprising a jacket disposed about the container, the jacket having an inner side and an exterior side, the inner side being disposed generally adjacent the container, the inner side being permeable to the hazardous liquid, a body of hazardous liquid swellable synthetic resin disposed between the inner side and the outer side, the body being liquid permeable, a flexible liquid barrier means being disposed about the jacket to prevent escape of liquid from the package in the event of rupture of the container.

Also contemplated within the scope of the present invention is a method of packaging a hazardous liquid, the steps of the method comprising; providing a container of a hazardous liquid, the container being subject to discharge of the contents thereof when subjected to impact, disposing the container within a jacket, the jacket having an inner wall and an exterior wall, a liquid permeable porous hazardous liquid swellable synthetic resin body being disposed between the inner and outer wall providing and a flexible impact resistant liquid containing means about the jacket.

Further features and advantages of the present invention will become more apparent when the following specification is taken in connection with the drawing wherein:

FIG. 1 depicts a partly cutaway view of a package in accordance with the invention.

FIG. 2 schematically depicts a jacket.

FIG. 3 schematically depicts a mode of cutting jackets from an appropriate sheet of material.

Figure 1:
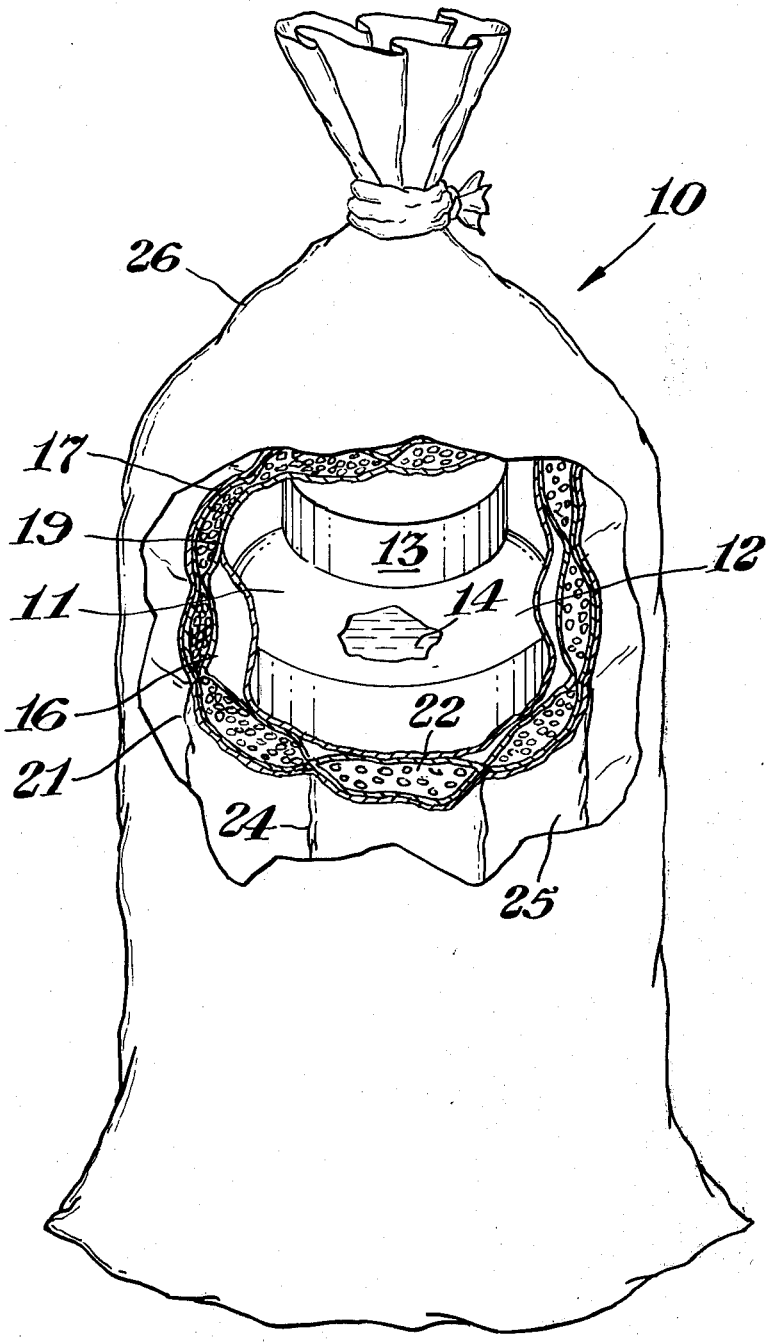

In FIG. 1 there is depicted a partly cutaway view of a package in accordance with the present invention generally designated by the reference number 10. The package 10 comprises in cooperative combination a hazardous liquid container 11. The container 11 as depicted in FIG. 1 is a glass bottle having a body 12 and a cap or closure 13. The bottle 12 has disposed therein a hazardous liquid 14 for example, an organic liquid such as chloroform or an aqueous liquid such as a potassium ferricyanide solution. The bottle 12 is entirely enclosed within a hazardous liquid permeable container fragment retaining jacket or first jacket 16. The jacket 16 beneficially is a textile fabric of the woven or non-woven variety or perforate synthetic resin film and of sufficient strength to retain at least the larger fragments of the bottle 12 if the bottle is subject to sufficient force to cause rupture thereof. The retaining means or jacket 16 in turn is surrounded by a second jacket 17. The jacket 17 has a first or inner wall 19 and a second or outer wall 21. The inner wall 19 is permeable to the hazardous liquid 14. Disposed generally between the inner wall 19 and the outer wall 21 is a hazardous liquid swellable and permeable body 22 beneficially of a synthetic resin. As depicted in FIG. 1 the body 22 is comprised of a plurality of particles contained between the inner wall 19 and the outer wall 21. The inner wall 19 and the outer wall 21 are joined at locations 24 and 25 and a number of other locations not shown, thus providing the jacket 17 with a quilted appearance. The periodic joining of the inner wall 19 and outer wall 22 maintains the swellable body 22 distributed over the inner surface 19. A flexible impact resistant liquid impermeable and generally vapor impermeable outer jacket 26 surrounds and encloses the jacket 17. Beneficially the jacket 26 is a tough plastic bag.

Figure 2:
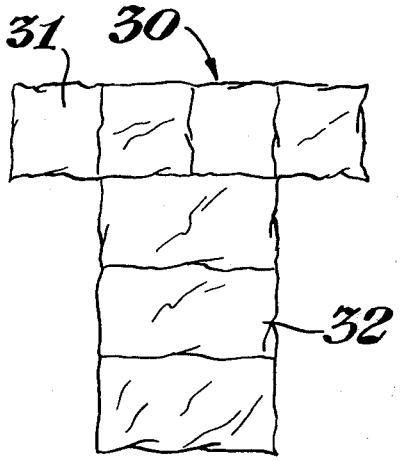

In FIG. 2 there is a schematic representation of a jacket 30 similar to the jacket 17 of FIG. 1. The jacket 30 beneficially is prepared from two layers of liquid permeable material having sandwiched therebetween hazardous liquid swellable particles. Each of the lines of FIG. 2 represents a joint between the inner wall and the outer wall of the jacket to give a generally "T" shaped jacket having a crosspiece 31 and a body 32. In order to prepare a package such as the package of FIG. 1 a container such as bottle 12 of FIG. 1 is disposed on the body 32 at its lowermost location. The body of the T is rolled about the container until a cylindrical jacket is formed. The jacket may be secured in position by any convenient means including tape having a pressure sensitive adhesive on one surface thereof; rubber bands, stitching, self adhering fabric such as is sold under the trade designation of "Velcro" and the like. The bottle such as the bottle 12 should not have a height which exceeds the width of the body 32 of the jacket. When the body 32 has been wrapped about a bottle such as bottle 12 the portion of the crosspiece of the T adjacent the body of the bottle, while either end of the crosspiece 31 projects from a more or less cylindrical jacket, each end is then tucked into the ends of the cylindrical jacket over the ends of the bottle.

Figure 3:
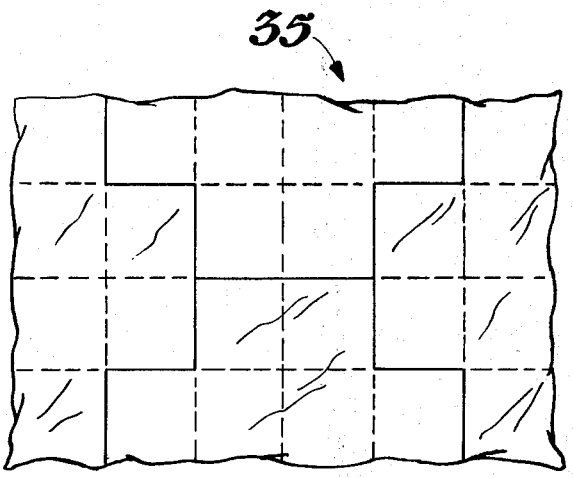

FIG. 3 depicts a convenient blank for the preparation of jacket members similar to that depicted in FIG. 2. Two rectangular pieces of suitable fabric are placed one on top of each other with a swellable resin disposed therebetween and the pieces of fabric or other suitable material are joined along all of the lines shown in the rectangle both solid and dotted. The rectangle is then cut along the solid lines contained within the rectangle to provide four jacket members.

Figure 4:
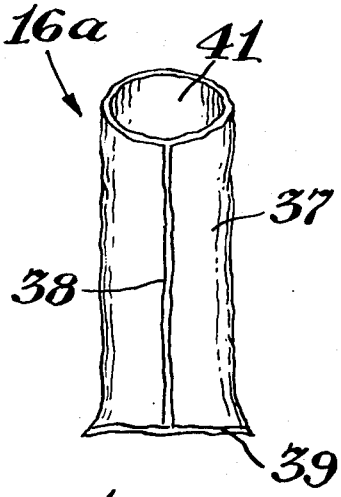
FIG. 4 is a representation of a container fragment retaining means.

FIG. 4 depicts a view of a container fragment retaining means generally designated by the reference number 16*a*. The retaining member 16*a* comprises a fabric body 37 which is permeable to a hazardous liquid. The body 37 has a generally cylindrical configuration. Joint 38 is formed between opposed edges of a sheet, which has been bent to a generally cylindrical configuration, to thereby form a tube having a closed end 39 and an open end 41. The closed end 39 is formed as shown in FIG. 4 bending the tube flat and joining the adjacent edge portions. Space within the jacket 16*a* should be at least sufficient to receive the desired container and the length of the jacket be sufficient to fold over the container and completely enclose it. Beneficially the jacket is at least about 1.3 to 1.5 times the height of the container to be enclosed.

Figure 5:
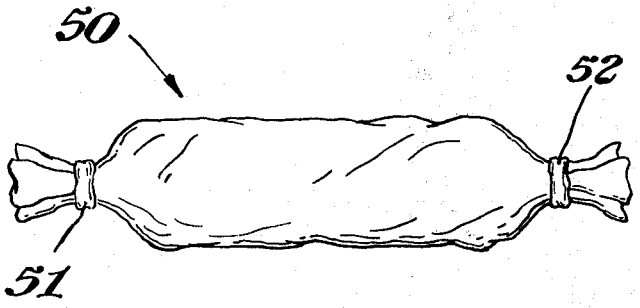
FIG. 5 depicts alternate jacket useful with the present invention.

In FIG. 5 there is schematically depicted a view of an alternate outer jacket generally designated by the reference numeral 50. The jacket 50 is disposed about a generally cylindrical rupturable container not shown. The jacket 50 has been formed from rectangular sheet which has been rolled about the bottle and the ends gathered and closed by retainer means 51 and 52 which advantageously may be pressure sensitive tape, hog rings, rubber bands, wire containing twist ties and the like. The embodiment set forth in FIG. 5 is particularly suitable where one or a relatively small number of containers are being packaged, and expediency rather than cost of packaging material is of primary importance.

Figure 6:
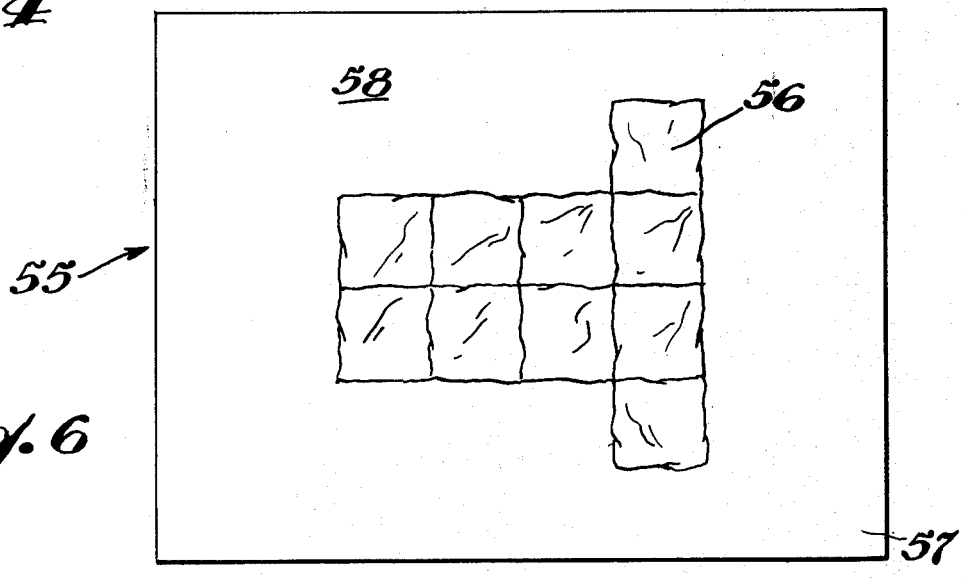
FIG. 6 depicts an alternate embodiment of jacket with a flexible liquid and vapor retaining means.

In FIG. 6 there is depicted an alternate outer jacket generally designated by reference number 55. Jacket 55 comprises a generally T shaped portion 56 generally equivalent to the jacket shown in FIG. 2. The portion 56 is disposed on and adhered to a flexible plastic film 57 having disposed on a surface thereof a pressure sensitive adhesive 58. The adhesive 58 is in contact with one surface of the jacket 56. Beneficially for transportation and storage the pressure sensitive adhesive 58 may be provided with a protective peelable sheet not shown. In using the embodiment of FIG. 6 a bottle or similar container in the fragment retaining jacket is placed at one end of jacket 55 and rolled in such a manner that the cross bar of the T is disposed at the top and bottom of the container. The ends of the cross of the T are then folded over the top and bottom of container and the adhesive 58 pressed firmly against adjacent film portions to provide a generally liquid-tight seal.

Figure 7:
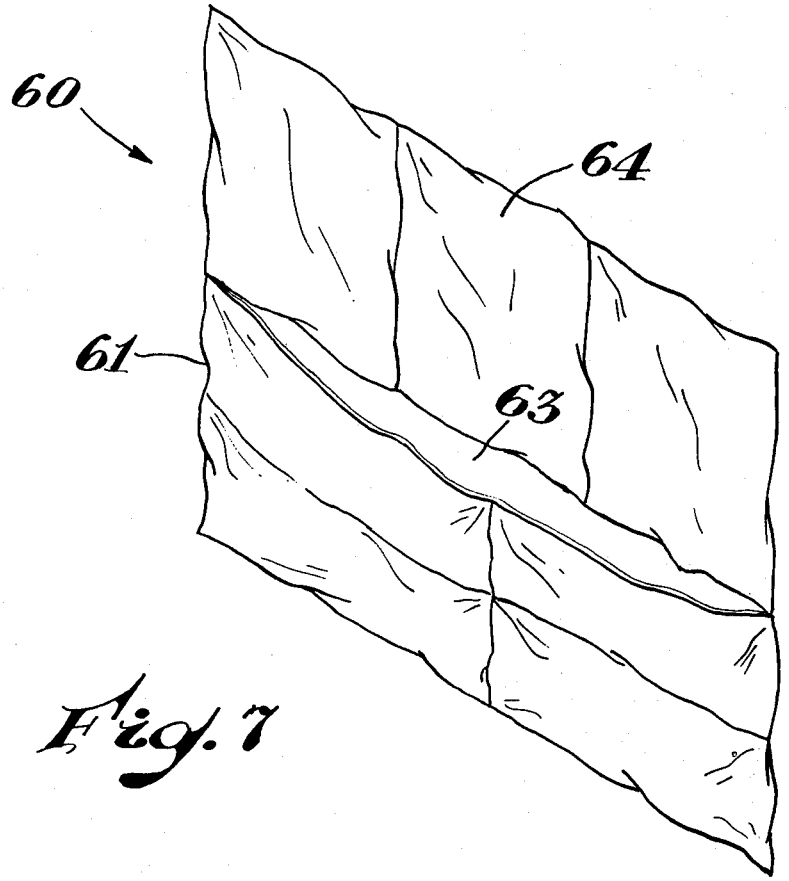
FIG. 7 is a view of an alternate jacket in accordance with the present invention.

In FIG. 7 there is depicted a view of an alternate jacket in accordance with the invention generally designated by the reference numeral 60. The package 60 has an envelope configuration having a body portion 61. Body portion 61 has a front wall 62 and a rear wall 63. Rear wall 63 has a flat portion 64. The jacket 60 functions generally in the manner of any envelope. A bottom or similar container is placed within the pouch between adjacent portions of the front and rear wall and the flap 64 positioned immediately adjacent the front wall within the space between the front and rear wall. A package such as depicted in FIG. 7 is readily prepared from a rectangular piece of material similar to that employed in the jacket 16 of FIG. 1 and the jackets of FIGS. 2, 3 and 5. If the material forming the inner face of the pouch, that is the visible surface of the back wall 63, is sufficiently tough a first jacket such as employed in the embodiment of FIG. 1 may be omitted. The pouch of FIG. 7 is particularly convenient in that it is readily usable with a wide variety of container sizes and shapes.

Figure 8:
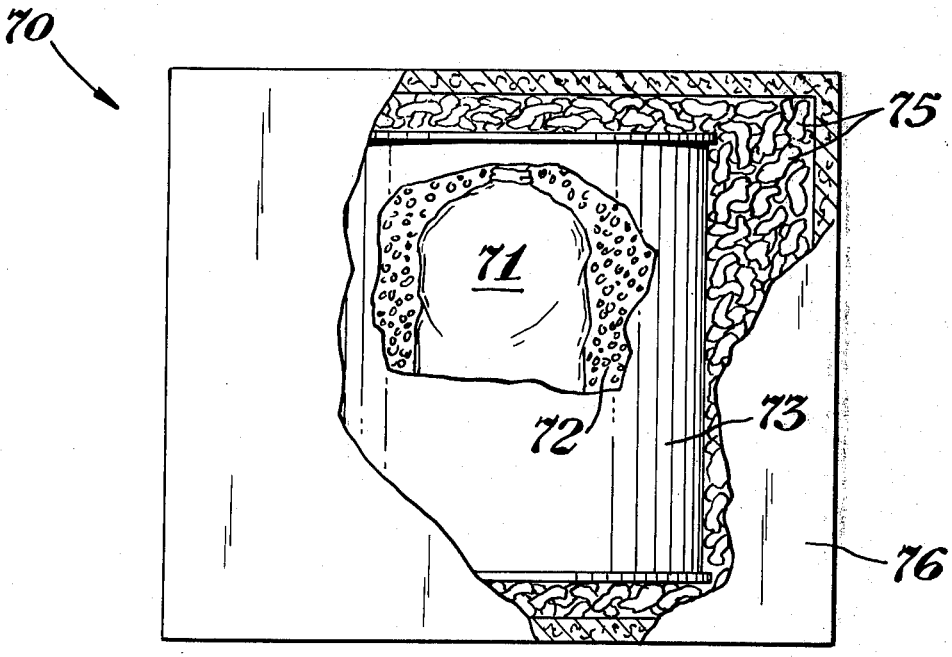
FIG. 8 shows a partly in-section of a package in accordance with the present invention in a shipping container.

In FIG. 8 there is depicted a sectional view of a shipping container generally designated by the reference numeral 70. The container 70 has disposed therein a package 71 such as that depicted in FIG. 1. The package 71 is surrounded by a particulate inorganic absorbent such as vermiculite and is designated by the reference numeral 72. Disposed about the particulate material 72 is a metal container 73 such as a conventional paint can with the closure locked on by means of clips not shown. The container 73 is surrounded by particulate foamed plastic dunnage material 75. The dunnage material in turn in contained within a corrugated paperboard carton 76. The package 70 of FIG. 8 is believed to provide adequate protection for the shipping of dangerous liquids under very adverse conditions. The metal container such as container 73 prevents vapor discharge from the package 71 over an extended period of time as the rate of diffusion of organic vapors through metal for practical purposes can be considered to be zero. A friable container within package 71 is protected by the particulate packaging material, the metal can, the plastic dunnage and the cushion of the particulate imbibing polymer body within the protected jacket of the package 71. If the package 70 is to be subjected to conditions of extremely high humidity of if it is probable that it is wet by rain, sea water or the like, a resin impregnated corrugated box may be employed.

A wide variety of materials may be employed to form an inner jacket such as the inner jacket 16. Woven fabrics of either natural or synthetic materials in general are satisfactory. It is generally desirable that the material of the inner jacket be one that is not rapidly attacked by the hazardous liquid with which it is to be used. The function of the inner jacket is principally to retain the fragments of the container when the container has been impacted sufficiently to cause breakage or rupture. Usually solvents do not attack the fabrics sufficiently rapidly to destroy the fabric during a period of impact. However, for many applications it is desirable that after the container has ruptured the fragments of the container, especially if it is a glass container, be retained within the first jacket to expedite disposal of glass shards and particles. It is highly desirable that the first jacket be readily permeated by the hazardous liquid with which it is to be used. It is through the first jacket that the hazardous liquid passes to the second jacket where it is imbibed. Perforate plastic film such as copolymers of ethylene and vinyl acetate containing 20 weight percent vinyl acetate polymerized therein is eminently satisfactory for many applications.

Generally the second or imbibing jacket beneficially can be prepared using inner walls and outer walls of generally like construction and composition to that of the first or fragment retaining jacket. For many applications flexible textile fabrics such as canvas, woven nylon, polyethylene polypropylene fabric, nonwoven nylon fabrics such as socalled spun bonded fabrics are very satisfactory. In selecting the appropriate material for the inner jacket and the walls of the outer or imbibing jacket due consideration must be given to the composition of the hazardous liquid with which particular jackets will be employed. Jackets of nylon and polypropylene are generally suitable for most organic hazardous liquid and most aqueous hazardous liquids. Polymers useful as the swellable member in the second or outer jacket are generally those polymers which swell in the hazardous liquid but do not dissolve therein.

Polymers useful in the present invention are any polymers which swell on contact with organic liquids or water. Selection of a polymer for use with any organic liquid or water is readily accomplished by determining a swelling index for the polymer particles. Beneficially, such a swelling index is readily determined by immersing a particulate polymer to be evaluated in water or organic liquid until the polymer has reached equilibrium swelling and determining the volume per unit weight of polymer after a period of 30 minutes with water or organic liquid. The ratio of the volume per unit weight with organic liquid or water to volume per unit weight of the polymer provides the swelling index. If the polymer is soluble the swelling index is infinite. If the swelling index is greater than about 1.2 the polymer particles are useful in the practice of the present invention. Beneficially for most applications swelling index of at least 1.5 and preferably greater than about 3 is desirable. It is not critical to practice of the present invention to employ a crosslinked polymer which swells but does not dissolve. If the polymer swells in the presence of the organic liquid or water it is suitable for the practice of the present invention. However, for most applications it is desirable to employ a polymer which is cross-linked to a sufficient degree that it exhibits a swelling index between about 1.5 and 50 and preferably between about 3 and 50. By utilizing the cross-linked polymer the hazard of dissolution of the polymer over extended periods of time is eliminated. However, for many applications particularly those where the quantity of polymer is large relative to the volume of the hazardous liquid, uncross-linked polymer is eminently satisfactory. A wide variety of polymeric materials are employed with benefit. Such polymers for organic liquids include polymers of styrenes and substituted styrenes; copolymers of vinyl chloride such as a copolymer of 60 weight percent vinyl chloride and 40 weight percent vinyl acetate; vinylidene chloride copolymers such as a copolymer of 75 percent vinylidene chloride and 25 percent acrylonitrile; acrylic polymers such as polymers of methylmethacrylate, ethyl acrylate and the like. In general the chemical composition of the polymers is not critical. The polymers such show significant swelling; that is, at least a 25 percent increase in volume in a period of at least 10 minutes in the organic liquid to which the polymers are required to respond under desired service conditions of temperature. Particularly advantageous materials which respond to a wide variety of organic liquids are polymers of styrene such as polystyrene and polymers of styrene and divinylbenzene containing up to about 10 weight percent divinylbenzene. For general use with aliphatic and aromatic hydrocarbons, alkylstyrene polymers are of particular benefit. Such alkylstyrene polymers swell very rapidly on contact with aliphatic and/or aromatic hydrocarbons. Generally the more rapid the swelling of the polymer, the more rapid the imbibition when the organic liquid is contacted. Alkylstyrene polymers usually show substantial swelling when in contact with organic liquids in less than 1 minute.

Preferably for many organic liquids, cross-linked polymers of styrenes, and advantageously of tertiary-alkylstyrenes, are utilized as the imbibing agent in the process of this invention. Those alkylstyrenes which can be used to prepare these polymers have alkyl groups containing from four to 20, and preferably from four to 12, carbon atoms such as: tertiary-alkylstyrenes including for example, p-tert-butylstyrene, p-tert-amylstyrene, p-tert-hexyl-styrene, p-tert-octylstyrene, p-tert-dodecylstyrene, p-tert-octadecylstyrene, and p-tert-eicosylstyrene; n-alkylstyrenes including for example n-butylstyrene, n-amylstyrene, n-hexylstyrene, n-octylstyrene, n-dodecyl-styrene, n-octadecylstyrene, and n-eicosylstyrene; sec-alkylstyrenes including for example sec-butylstyrene, sec-hexylstyrene, sec-octylstyrene, sec-dodecylstyrene, sec-octadecylstyrene, and sec-eicosylstyrene; isoalkyl-styrenes including for example isobutylstyrene, iso-amylstyrene, isohexylstyrene, isooctylstyrene, isododecyl-styrene isooctadecylstyrene, and isoeicosylstyrene; and copolymers thereof.

Especially preferred for use in the practice of the invention are cross-linked copolymers of such alkylstyrenes as heretofore described and an alkyl ester derived from $C_1$ to $C_{24}$ alcohol and acrylic or methacrylic acid or mixtures thereof.

Suitable monomers which may be employed as comonomers with the alkylstyrene include such materials as vinylnaphthalene, styrene, $\alpha$-methylstyrene, ring-substituted $\alpha$-methylstyrenes, halostyrenes, arylstyrenes and alkarylstyrenes; methacrylic esters, acrylic esters, fumarate esters and half esters, maleaste esters and half esters, itaconate esters and half esters, vinyl biphenyls, vinyl esters of aliphatic carboxylic acid esters, alkyl vinyl ethers, alkyl vinyl ketones, $\alpha$-olefins, isoolefins, butadiene, isoprene, dimethylbutadiene, acrylonitrile, methacrylonitrile and the like.

It is desirable that the polymers used in the process of the invention contain a slight amount of cross-linking agent, preferably in the range of from about 0.01 to 2 percent by weight. The most eficient imbibition of organic liquid or water occurs when the level of cross-linking agent is less than about 1 percent since this permits the polymers to swell easily and imbibe a substantial volume of the organic or aqueous material.

Cross-linking agents which can be used in preparing the imbibing polymers suitable for use in the present invention include polyethylenically unsaturated compounds such as divinylbenzene, diethylene glycol dimethacrylate, diisopropenylbenzene, diisopropenyldiphenyl, diallylmaleate, diallylphthalate, allylacrylates, allylmethacrylates, allyfumarates, allylitaconates, alkyd resin types, butadiene or isoprene polymers, cyclooctadiene, methylene norbornylenes, divinyl phthalates, vinyl isopropenylbenzene, divinyl biphenyl, as well as any other di- or poly-functional compound known to be of use as a cross-linking agent in polymeric vinyl-addition compositions.

Normally, the polymer containing the cross-linking agent swells with the imbibed organic material or water. If there is too much cross-linking agent, the imbibition takes an unreasonably long time or the polymer is unable to imbibe a sufficient quantity of the organic liquid or water and closes the interstitial spaces in the body. If the imbibitional polymer contains no cross-linking agent or too little cross-linking agent, then it will dissolve eventually in the water or organic material resulting, for example, in a non-discrete, non-particulate mass of polymer-thickened organic liquid or water. However, for many applications where exterior packaging is sufficiently large, uncross-linked material is satisfactory.

Polymers for the practice of the method of the present invention may be prepared by any convenient technique, either suspension, emulsion or mass polymerization. Generally, the method of preparation is selected to provide a polymer in the most convenient form for any particular application. Thus, if it is desired to have free-flowing, readily packed beads, generally suspension polymerization is employed to provide a plurality of small beads. It is oftentimes desirable to employ an emulsion polymerization technique and recover the polymer by spray drying if most rapid imbibition is desired. If it is desired to obtain a body of predetermined configuration, it is oftentimes beneficial to employ a mass polymerizaton technique wherein a polymer-insoluble diluent is employed. Techniques for the preparation of such porous polymers are disclosed in U.S. Pat. No. 3,322,695, the teachings of which are herewith incorporated by reference. Such porous polymers can also be prepared by either suspension or mass polymerization. Alternately, satisfactory beads are prepared by mass or suspension polymerization with subsequent comminution of the polymer prepared by the mass technique. The particle size of such polymers is selected in accordance with the desired application, larger particles being employed for slower imbibition, smaller particles for higher absorption and rapid imbibition. For most applications such particles are from about 0.1 to 5 millimeters in diameter. Alternately, porous polymer beads may be polymerized in desired shapes in the manner disclosed by U.S. Pat. No. 3,322,695.

A wide variety of water soluble polymers may be employed in the practice of the present invention when the hazardous liquid is of an aqueous nature. Such polymers include lightly cross-linked hydrolyzed polyvinylacetate, polyvinylethers, polyacrylamide, acrylamide copolymers, cellulose, particularly finely divided cellulose, acrylic acid polymers, suitable water swellable polymers are disclosed in the U.S. Pat. Nos. 3,686,024, 3,407,138, 3,661,142, 2,923,692, and 2,810,716, the teachings of which are incorporated by reference hereto. In addition cross-linking can be induced in at least some polymers by chemical addition after formation of the polymer or by exposure to ionizing radiation.

A wide variety of synthetic resinous thermoplastic films are suitable for use as the outer container such as container 26 shown in FIG. 1. Barrier films are well known and are shown in U.S. Pat. No. 3,524,795, U.S. Pat. No. 3,613,957 and U.S. Pat. No. 3,740,258 which employ surface sulfonation to provide resistance to passage of organic hydrocarbon materials through plastic substrates. Surface fluroination is also employed to provide desirable barrier films. Such films are disclosed in U.S. Pat. No. 2,811,468 and U.S. Pat. No. 3,647,613. The teachings of the hereinbefore delineated patents are incorporated by reference thereto.

By way of further illustration an 8 ounce cylindrical wide mouth bottle is packaged within a first jacket of spun bonded non-woven polyolefin fabric sold under the trade designation of Lok-Tuft which has been heat-sealed to provide a generally cylindrical bag about three inches greater in length than the height of the bottle. An outer jacket is prepared having the general configuration of the jacket shown in FIG. 2 wherein the body of the T measured about 16 inches in length and the width is about ½ inch greater than the height of the bottle. The cross bar of the T has end portions which are about ½ inch longer on a side than the diameter of the bottle. The jacket contained between the inner and outer wall thereof a layer of organic liquid imbibing beads having diameters of about 150–700 microns, about 3/16 inch in thickness. The bottle, in the first jacket, was wrapped in the second jacket in the manner essentially shown in FIG. 1 and the jacket maintained in position by means of the cellophane tape. The wrapped jacketed bottle was then placed within a polyethylene bag having a wall thickness of about 4 mils. The resultant package was then swung overhand and impacted on a desk top repeatedly. The glass bottle was not broken. A similar package was prepared wherein the bottle contained about 6 ounces of tetrachloroethylene and the package was impacted with a hammer to break the bottle. After a period of about 10 minutes the package was opened. The outer bag was intact, the outer jacket was intact but greatly increased in volume. The inner jacket was slightly damp from the solvent. All glass fragments were retained within the inner jacket. Within one to two minutes the second or outer jacket was dry to the touch. No liquid solvent was observed nor could any be manually squeezed from the jacket. In a manner similar to the foregoing illustration other organic hazardous chemicals are readily protected in accordance with the invention. When water swellable polymer is substituted for the organic imbibed polymers and an aqueous hazardous liquid is placed within the bottle, similar results are obtained.

The packages of the present invention are not recommended for strongly oxidizing liquids such as nitric acid and the like.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A package for the containment and shipping of hazardous liquids within a container which is subject to discharge of the contents of the container when the container is subject to impact sufficient to rupture the container, the package comprising a jacket disposed about the container, the jacket having an inner side and an exterior side, the inner side being disposed generally adjacent the container, the inner side being permeable to the hazardous liquid, a body of hazardous liquid swellable synthetic resin disposed between the inner side and the outer side, the body being liquid permeable, a flexible liquid barrier means being disposed about the jacket to prevent escape of liquid from the package in the event of rupture of the container.

2. The package of claim 1 wherein the body of hazardous liquid swellable synthetic resin is particulate.

3. The package of claim 1 wherein the swellable synthetic resin is swellable in organic liquids.

4. The package of claim 1 wherein the swellable synthetic resin is water swellable.

5. The package of claim 1 wherein the jacket is a textile fabric.

6. The package of claim 1 wherein the jacket in a development form has a T shaped configuration.

7. The package of claim 1 wherein a jacket has a pouch configuration.

8. The package of claim 1 including a fragment retaining jacket disposed immediately adjacent the container.

9. The package of claim 1 disposed within a paperboard box and surrounded by inorganic material which is in turn surrounded by a particulate cushioning packing which is contained within a shipping container.

10. A package for the containment and shipping of hazardous liquids within a glass container which is subject to breakage on impact, the package comprising a jacket disposed about the glass container, the jacket having an inner side and an outer side, the inner side being of a textile fabric and of sufficient strength to retain fragments of the glass container in the event the glass container is ruptured, a body of hazardous liquid swellable particulate synthetic resin particles disposed between the inner side and the outer side, the inner side of the jacket being liquid permeable, a plastic layer disposed about the outer jacket to provide a barrier to movement of vapor of the hazardous liquid from the package.

11. A method of packaging a hazardous liquid, the steps of the method comprising; providing a container of a hazardous liquid, the container being subject to discharge of the contents thereof when subjected to impact, disposing the container within a container fragment retaining enclosure, the fragment containing enclosure being permeable to the hazardous liquid, enclosing the container fragment retaining means within a jacket, the jacket having an inner wall and an exterior wall, a liquid permeable porous hazardous liquid swellable synthetic resin body being disposed between the inner and outer wall and providing a flexible impact resistant liquid containing means about the jacket.

* * * * *

UNITED STATES PATENT AND TRADEMARK OFFICE

CERTIFICATE OF CORRECTION

PATENT NO. : 3,999,653

DATED : December 28, 1976

INVENTOR(S) : Daniel H. Haigh, Richard H. Hall, Edwin G. Larson

It is certified that error appears in the above-identified patent and that said Letters Patent are hereby corrected as shown below:

Column 1, line 9, delete "in" and insert --an--.

Column 2, line 11, insert --view-- after the words "in-section".

Column 2, line 16, delete "number" and insert --numeral--.

Column 2, line 61, delete "T" and insert --"T"--.

Column 3, lines 3, 47, 59 & 61, delete "T" and insert --"T"--.

Column 4, line 4, delete "bottom" and insert --bottle--.

Column 4, line 29, delete "in", second instance, and insert --is--.

Column 4, line 43, delete "of", second instance, and insert --or--.

Column 4, line 44, delete "is", second instance, and insert --be--.

Column 5, line 7, delete "socalled" and insert --so-called--.

Column 5, line 36, insert --the-- after the word "to".

Column 5, line 60, delete "such" and insert --must--.

Column 6, line 28, insert --,-- after the word "isododecyl-styrene".

Column 6, line 41, delete "maleaste" and insert --maleate--.

Column 6, line 51, delete "eficient" and insert --efficient--.

UNITED STATES PATENT AND TRADEMARK OFFICE

CERTIFICATE OF CORRECTION

PATENT NO. : 3,999,653

DATED : December 28, 1976

INVENTOR(S) : Daniel H. Haigh, Richard H. Hall, Edwin G. Larson

It is certified that error appears in the above-identified patent and that said Letters Patent are hereby corrected as shown below:

Column 6, line 62, delete "allyfumarates" and insert --allylfumarates--.

Column 7, line 28, delete "polymerizaton" and insert --polymerization--.

Column 7, line 40, delete "higher" and insert --high--.

Column 7, line 54, delete "3,661,142" and insert --3,661,154--.

Column 7, line 67, delete "fluroination" and insert --fluorination--.

Column 8, lines 12 and 14, delete "T" and insert --"T"--.

Column 8, line 61, delete "subject" and insert --subjected--.

Column 9, line 13, delete "development" and "T" and insert --developed-- and --"T"--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*